US006981890B2

(12) United States Patent
Cutler et al.

(10) Patent No.: US 6,981,890 B2
(45) Date of Patent: Jan. 3, 2006

(54) ELECTRICAL CONNECTOR WITH IMPROVED LOCKING MEANS

(75) Inventors: Stephen Cutler, P.O. Box 333, Captiva, FL (US) 33924; Paul A. Verwer, Sanibel, FL (US)

(73) Assignees: Stephen Cutler, Captiva, FL (US), part interest; Sue Ellen Cutler, Captiva, FL (US), part interest ( * ) Notice: Subject to any disclaimer, the term of this patent is extended or adjusted under 35 U.S.C. 154(b) by 681 days.

(21) Appl. No.: 09/827,048

(22) Filed: Apr. 5, 2001

(65) Prior Publication Data

US 2001/0010981 A1 Aug. 2, 2001

Related U.S. Application Data

(63) Continuation of application No. 09/340,234, filed on Jul. 1, 1999, now Pat. No. 6,257,919.

(51) Int. Cl.
*H01R 4/24* (2006.01)

(52) U.S. Cl. ..... 439/441; 439/910

(58) Field of Classification Search ..... 439/441, 439/436, 437, 438, 439, 440, 835, 910, 393, 439/44 B See application file for complete search history.

(56) References Cited

U.S. PATENT DOCUMENTS 3,085,177 A 4/1963 Thompson
3,945,711 A 3/1976 Hohorst et al.
4,397,514 A 8/1983 Durand et al.
4,566,748 A * 1/1986 Tanishi et al. ..... 339/95
4,585,902 A 4/1986 Munroe
4,673,232 A * 6/1987 Kubota et al. ..... 439/441
4,768,976 A * 9/1988 Gelati ..... 439/441
4,824,395 A 4/1989 Blaha
5,098,316 A 3/1992 Köllmann et al.
5,149,279 A 9/1992 Kruse
5,454,730 A * 10/1995 Tozuka ..... 439/438
5,494,456 A 2/1996 Kozel et al.
6,012,944 A 1/2000 Hatakeyama

* cited by examiner

*Primary Examiner*—Alex Gilman
(74) *Attorney, Agent, or Firm*—Renner, Otto, Boisselle & Sklar, LLP

(57) ABSTRACT

A locking connector is provided for electrically interconnecting first and second electrical conductors. The connector includes an enclosure that accommodates an electrical contact component electrically interengaged with the first conductor. At least two spring locking clips are mounted in the enclosure and serially arranged to face away from the inlet such that the clips are sequentially and resiliently opened by introducing the second conductor into the enclosure through the inlet. The clips are spring biased to grip the second conductor at a plurality of locations and hold the second conductor in electrical interengagement with the contact component. This enables the second conductor to resist disengagement from the contact component.

14 Claims, 6 Drawing Sheets

ELECTRICAL CONNECTOR WITH IMPROVED LOCKING MEANS

RELATED APPLICATION

The present application is a continuation of U.S. application Ser. No. 09/340,234, filed Jul. 1, 1999 now U.S. Pat. No. 6,257,919.

FIELD OF THE INVENTION

This invention relates to an electrical connector having a multiple spring locking mechanism.

BACKGROUND OF THE INVENTION

The standard wire nut is a common device currently available for electrically and mechanically interconnecting two or more segments of electrical wiring. First, the individual sections of wire are twisted together and then the nut is screwed onto the wire. This procedure is usually tedious and time consuming, particularly for residential and business construction applications wherein a large number of connections are typically needed. Effectively securing the nut to the wires usually requires practiced skill and experience. As a result, labor costs tend to be high. Conventional wire nut connections also tend to be less than optimally secure. Wires are apt to loosen and become disconnected. Considerable time and effort may be required to locate and repair a defective connection.

Crimp connectors are also widely used. However, the crimping process often destroys the connector and renders it ineffective. It is usually quite difficult to perform the crimping process correctly. Moreover, the crimp connector tends to pull apart from the wire fairly easily.

Soldering electrical conductors together necessitates the use of soldering equipment, supplies and a power source. The soldering process again usually requires a measure of skill and experience. This type of electrical connection is often difficult to perform in the field.

Wire trap connectors have also been used to join segments of electrical wiring. These devices typically employ a spring clip contact mounted within a multiple piece plastic housing. Electrical wires are introduced through openings in the housing to engage the contact. The wires are held in place by respective spring clips. This device represents an improvement over previous connectors; however, it is still often possible for the wiring to separate from the connector. Moreover, in some cases, if the wiring is pulled with sufficient force, the individual parts of the housing can separate to expose the electrical contact and the ends of the wiring. This can result in failure of the wiring. Additionally, known wire trap connectors are ineffective for use with stranded wire, which lacks the rigidity needed to open the spring clip.

A need exists for a connector that is not only quick and convenient for both skilled and unskilled persons to use but also provides an improved and much more secure mechanical and electrical connection. A need also exists for a connector that can be employed in a wide variety of applications and environments.

SUMMARY OF THE INVENTION

It is therefore an object of this invention to provide an electrical connector that provides for a significantly improved locking interconnection between segments of electrical wire or other type of electrical conductor.

It is a further object of this invention to provide an electrical connector that mechanically joins respective conductive components so securely that it is virtually impossible to unintentionally disconnect the components.

It is a further object of this invention to provide an electrical connector that permits large numbers of electrical connections to be made quickly and conveniently, even by persons with little or no electrical training, and which is therefore extremely desirable for use in many various residential, commercial, industrial, marine and other applications.

It is a further object of this invention to provide an electrical connector that employs a virtually indestructible one piece enclosure which resists being pulled apart even under enormous stress.

It is a further object of this invention to provide a virtually indestructible assembly which resists being pulled apart even under enormous stress.

It is a further object of this invention to provide an electrical connector that locks sections of electrical wire securely together but which employs a convenient, optional spring release mechanism that allows the wires to be disconnected (and stranded wire to be connected), as required.

It is a further object of this invention to provide an electrical connector that improves both mechanical and electrical connection by using a spring lock that grips the conductive components at multiple locations.

It is a further object of this invention to provide an electrical connector that achieves considerable time, labor and expense savings in commercial, residential, industrial, marine and other applications.

It is a further object of this invention to provide an electrical connector that exhibits a substantial area of electrical contact and which achieves improved electrical conductivity while generating minimal heat.

It is a further object of this invention to provide an electrical connector that works effectively with virtually all types of wires and other electrical conductors, including stranded, solid and shielded wire.

It is a further object of this invention to provide an electrical connector that is extremely convenient to use and install in the field.

It is a further object of this invention to provide an electrical connector that exhibits improved durability and is virtually indestructible.

It is a further object of this invention to provide an electrical connector that may be used in a wide variety of electrical applications and connecting environments including, but not limited to wiring, plugs, fixtures, appliances, switches, receptacles and service panels.

This invention features a looking connector for electrically interconnecting first and second electrical conductors, such as first and second sections of electrical wire. An electrical contact component is electrically interengaged with the first conductor. The contact component includes first and second, spaced apart contact sections and an intermediate contact section that interconnects the first and second sections. The intermediate contact section includes an opening that receives the second conductor. A set of at least two spring locking clips are mounted to the first contact section and generally serially arranged to face away from the opening in the intermediate contact section such that the clips are sequentially and resiliently opened by introducing the second conductor through the opening. The clips are spring biased to grip the second conductor at a plurality of locations and hold the second conductor in electrical interengagement with the second contact section. As a result, the clips resist disengagement of the second conductor from the contact component.

In preferred embodiments, the device further includes an enclosure that accommodates the contact component and the spring clips. The enclosure has an inlet aligned with the opening for receiving the second conductor.

The contact component may include a unitary, conductive element. The first and second contact sections may comprise a generally parallel pair of plates. The spring clips may be secured to a first plate and spring biased to urge the conductor against the other, second plate. At least one of the spring clips may comprise a leaf spring. Each spring clip may include a first generally planar segment that engages and is connected to the first plate, a second segment that is connected to the first segment at an angle and unitary spring means for urging the second segment apart from the first segment and into gripping interengagement with the second conductor.

The first plate may carry a pair of generally parallel lips that extend transversely therefrom. The first segment of one of the clips may be interconnected between the intermediate contact section wall and one of the lips, and the first segment of the other clip may be interconnected between the pair of lips. A distal lip may extend transversely from the second plate for limiting the extent to which the second conductor may be introduced through the opening of the contact. The second plate may include guide means for locating the second conductor relative to the second plate. This guide means may comprise an elongate rib formed in the second plate.

Release hole means may be formed through the enclosure and the second plate for receiving a release element. The release element may include a plurality of pins that are inserted through respective release holes formed through the enclosure and the second plate of the contact. The release element thereby urges the second spring clip segments simultaneously into an open condition wherein the second segments are disengaged from the second conductor such that the second conductor may be removed from the enclosure.

In various embodiments, multiple wires or other conductors may be secured by respective serially arranged pairs of spring clips constructed in the above manner. Three or more aligned spring clips may also be used for locking a respective conductor in interengagement with the contact.

The locking connector may be employed in a wide variety of household and commercial applications. For example, the connector may be utilized to releasably interconnect two or more sections of electrical wiring. Alternatively, the connector may be employed in a plug, electrical service panel, lighting fixture, light switch box and various industrial, marine and other applications. Serial and parallel connections may be made.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE PREFERRED EMBODIMENTS

Figures 1, 2:
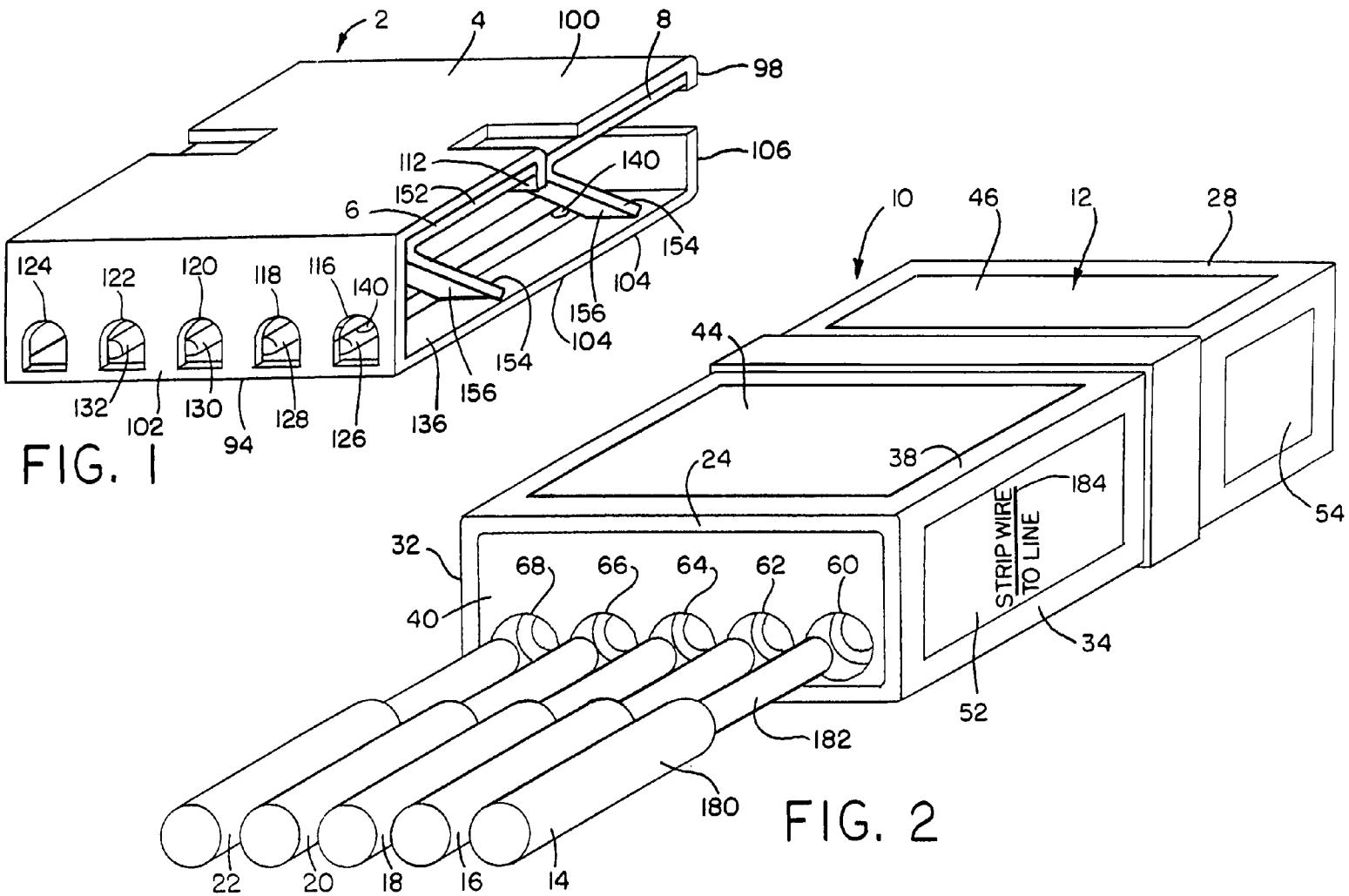
FIG. 1 is an enlarged perspective view of a preferred locking connector assembly according to this invention.
FIG. 2 is a perspective view of a preferred electrical connector in which the locking connector assembly of FIG. 1 is incorporated in an enclosure.

There is shown in FIG. 1 a preferred form of locking connector assembly 2 in accordance with this invention. The assembly features a conductive contact component 4 that carries a pair of serially arranged spring locking clip components 6 and 8. Assembly 2 may be used to accomplish a virtually limitless variety of electrical connections. The assembly may be carried within a plastic enclosure as described below, may be used without an enclosure and/or may be incorporated into various appliances, fixtures, switches, plugs and other items that require electrical connection.

There is shown in FIG. 2 a preferred electrical connector 10, which includes the locking connector assembly 2 mounted in a rectilinear enclosure 12 according to this invention. Connector 10 is designed for electrically and mechanically interconnecting a plurality of wires or other types of electrical conductors in a quick, secure and reliable manner. In the version shown in FIG. 2, five electrical wires 14, 16, 18, 20 and 22 are joined by connector 10. In alternative versions of this invention, various other numbers of wires may be interconnected by the device. These wires may be attached to the same end of the electrical connector, as shown in FIG. 1 or alternatively, may be joined to opposing ends of the connector, in a manner that is more fully described below. The connector of this invention may also be incorporated into a device or appliance such as an electrical service panel, plug, electrical fixture or switch that is engaged by a wire or other conductor. It should be understood that connector 10 may be employed for virtually all household, commercial, industrial, marine and other applications wherein electrical connection is required.

Enclosure 12 is shown alone in FIGS. 4 through 8 and preferably features a molded or fused unitary plastic construction including front and rear ends 24 and 26, respectively, top and bottom 28 and 30, respectively and left-hand and right-hand sides 32 and 34, respectively. In certain versions, the enclosure 12 may comprise two separate pieces that are fused together such as along seam 36 in FIG. 3. Alternatively, the enclosure may comprise a unitary molded plastic. A peripheral ridge 38 may be formed unitarily in the enclosure such that it surrounds the enclosure. Additionally, each end of the enclosure may include one or more recesses. For example, ends 24 and 26 include recesses 40 and 42, respectively. Top 28 and bottom 30 each feature a pair of respective recesses 44, 46, and 48, 50; and sides 32 and 34 include a pair of recesses 52 and 54 (shown only for side 34 in FIG. 7). The peripheral ridge 38 and the recesses 40 through 54 provide the enclosure 22, and therefore connector 10, with a much improved grip so that electrical wires may be more conveniently connected to and, if necessary, removed from the connector.

Figure 3:
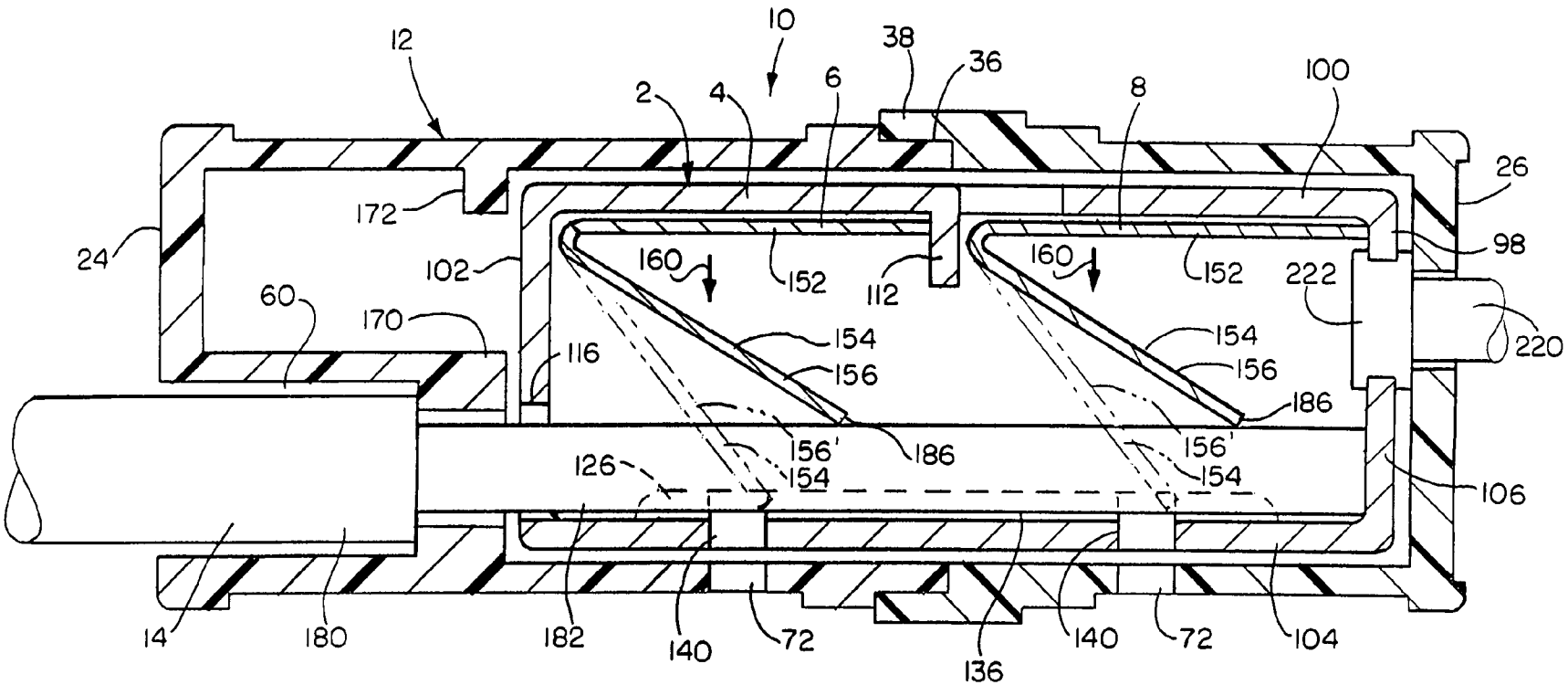
FIG. 3 is an enlarged fragmentary longitudinal section through the electrical connector of FIG. 2.
Figure 6:
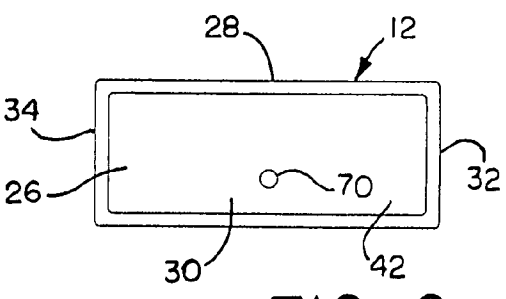
FIG. 6 is a rear elevational view of the enclosure.
Figure 5:
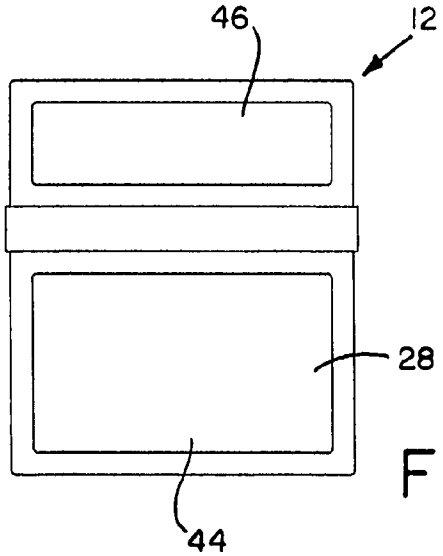
FIG. 5 is a top plan view of the enclosure.
Figure 8:
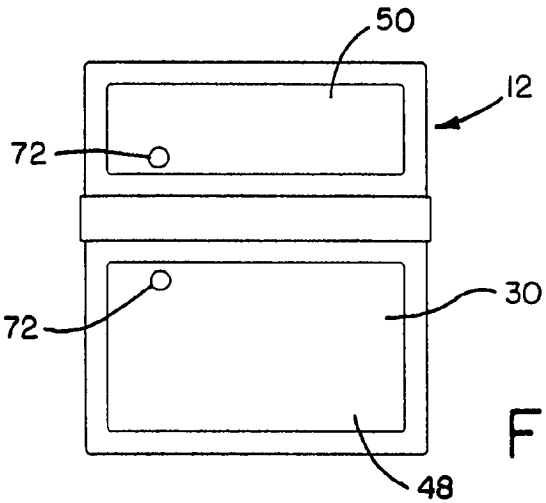
FIG. 8 is a bottom plan view of the enclosure.
Figure 4:
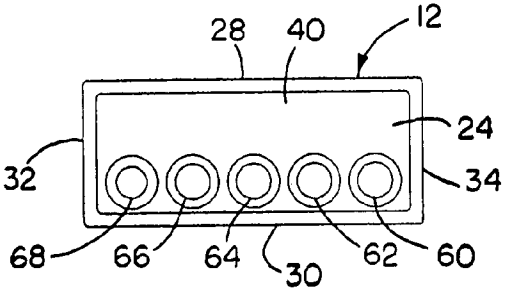
FIG. 4 is a front elevational view of the enclosure of FIG. 2.

Various types of holes, apertures or openings may be formed in enclosure 12. As shown in FIGS. 2, 3 and 4, a plurality of inlets 60, 62, 64, 66 and 68 are formed side by side in front end 24. Each inlet is sufficiently large to accommodate a respective one of the wires 14 through 22. For example, wire 14 is shown positioned for insertion into inlet 60 in FIG. 2. The remaining wires are respectively positioned for insertion into the other inlets in a similar manner. Enclosure 12 also includes various other optional openings such as an electrical conductivity test hole 70 that is formed in rear end 26, as shown in FIG. 6. Also a pair of spring release holes 72, FIG. 8, may be formed in recesses 48 and 50 of bottom surface 30. Holes 70 and 72 function as described more fully below.

As best illustrated in FIG. 3, the locking connector assembly 2 is permanently mounted within enclosure 12. Assembly 2, shown by itself in FIG. 1, includes a contact component 4 having a generally C-shaped cross sectional configuration, and a pair of leaf spring locking clips 6 and 8 mounted within contact component 4.

Figure 9:
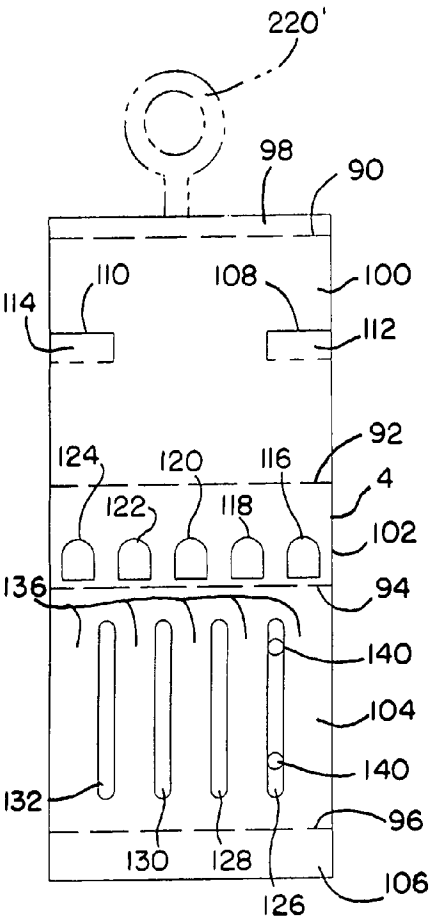
FIG. 9 is a top plan view of the electrical contact component of the locking connector assembly prior to assembly.

Contact component 4 is depicted by itself in FIGS. 9 through 13. Initially, as best shown in FIG. 9, the contact component 4 is constructed from a substantially flat sheet composed of a conductive metal material. This may include tin plated copper or other conductive materials that will be known to those skilled in the art. The contact sheet is cut, stamped and/or otherwise machined to include an assortment of features. For example, a plurality of transverse fold lines 90, 92, 94 and 96 are formed in the contact strip. Fold line 90 separates a first lip section 98 from a first plate section 100. Fold line 92 divides plate section 100 from an intermediate wall section 102. Third fold line 94 separates wall section 102 from a second plate section 104. Finally, fold line 96 separates plate section 104 from a lip section 106. Transverse cuts 108 and 110 are formed in opposite edges of plate 100 and the cut material is folded downwardly (i.e., in a direction into the drawing) to form additional lips 112 and 114 that depend from plate 100.

A plurality of openings or apertures 116 through 124 are formed side by side in wall section 102. These apertures correspond in number and location, and are aligned with the inlet holes 60 through 68 formed in enclosure 12. It should be understood that in alternative embodiments, various other numbers of apertures may be formed in wall section 102. In still other versions, the intermediate wall 102 and second plate 104 may be eliminated and spaced apart contact sections, or at the least a single contact section, may be mounted within an enclosure. A plurality of substantially parallel guide ribs 126, 128, 130 and 132 are formed longitudinally front to back in contact section 104. These ribs define a plurality of aligned channels 136 that accommodate respective electrical wires when the contact component 4 is assembled in the manner described below. A pair of spring release holes 140 are formed through rib 126. In alternative versions additional release holes may be formed in one or more of the other ribs. Each rib is formed such that it is aligned with the space between an adjoining pair of the apertures 116 through 124 in wall 102.

A contact component 4 constructed preliminarily in the manner shown in FIG. 9 is fully assembled as shown in FIGS. 10 through 13. Specifically, the contact 4 is folded along fold lines 90, 92, 94 and 96. As a result, contact 4 assumes the shape shown in FIGS. 1, 3, 10 through 13 and 15. Plates 100 and 104 are spaced apart and interconnected by wall 102. The plates maintain a generally parallel condition relative to one another. Lip 98 depends from upper plate 100 as shown in FIGS. 1, 3, 11, 12 and 15. Likewise, lips 112 and 114 depend from plate 100. Distal lip 106 extends upwardly from plate 104, FIGS. 1, 3, 12, 13 and 15. Ribs 126 through 132 extend along the inside, upwardly facing surface of plate 104. The apertures 116 through 124 are arranged side by side across wall 102 and each aperture is aligned with a respective channel 136, as best shown in FIGS. 1 and 9.

Figure 14:
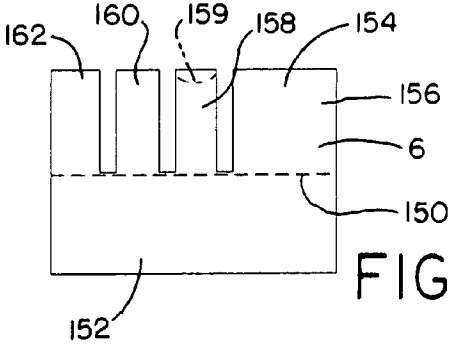
FIG. 14 is a top plan view of a preferred spring locking clip of the locking connector assembly in a pre-assembled condition.
Figure 15:
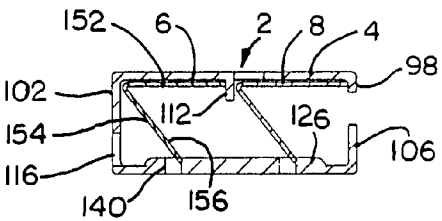
FIG. 15 is an elevational side view of the electrical contact component and spring locking clip in a fully folded and assembled condition.
Figure 10:
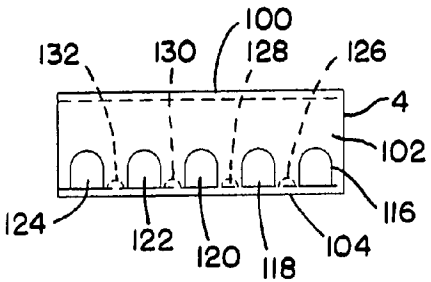
FIG. 10 is a front elevational view of the front end of the electrical contact component of FIG. 9 after assembly.
Figure 12:
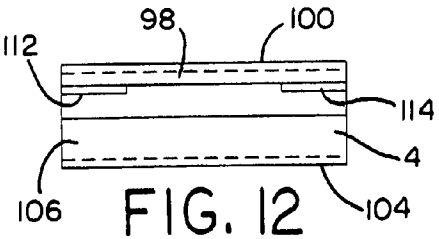
FIG. 12 is an elevational view of the rearward end of the electrical contact component of FIG. 10.
Figure 13:
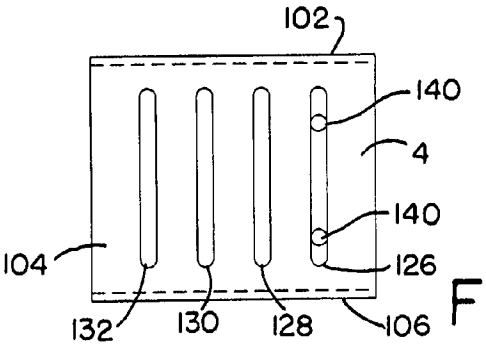
FIG. 13 is a bottom plan view of the electrical contact component of FIG. 10.

Leaf spring locking clips 6 and 8, FIGS. 1, 3 and 15, are attached to contact component 4. A preferred spring clip 6 is shown prior to assembly in FIG. 14. It should be understood that spring clip 8 and any other spring clips used in the connector are preferably constructed in an analogous fashion. Typically, the spring clip is formed from a generally flat piece of resilient metal. Non-metallic springs may also be used. A fold line 150 is formed transversely across the clip. This material should have sufficient resilience such that it serves as a leaf spring when the component is folded or bent along fold line 150. More particularly, clip 6 includes a first planar segment 152 and a second planar segment 154 that is cut longitudinally at spaced apart intervals to form spring arms 156, 158, 160 and 162. Spring arm 156 has a width that is approximately twice as great as the remaining spring arms. The spring arms are shown with transversely flat configurations; however, some embodiments of the spring arms may be transversely curved (see phantom edge 159 in FIG. 14) to conform to the shape of a wire to be contacted. The clip is folded along fold line 150 and inserted into contact 4 (either before or after the contact is assembled) such that clip segment 152 extends between wall 102 and lip 112. See FIGS. 1, 3 and 15. This fit is sufficiently tight such that the spring clip is held permanently in place in the contact 4 and effectively becomes part of the contact. It should be noted that the opposite end of segment 152 similarly fits between wall 102 and opposite depending lip 114. The folded segment 154 of component 6 depends downwardly from segment 152 at an angle and the folded leaf spring includes a spring bias that urges segment 154 downwardly as indicated by arrow 160 in FIG. 3 into the phantom line position shown in FIG. 3.

The second spring clip 8 is constructed in a similar manner and is likewise mounted permanently within contact component 4. In this case, the upper clip segment 152 is fit securely between lips 112 and 114, and lip 98. The locking spring clip is folded and again includes a spring bias that urges clip segment 154 downwardly as indicated by downward arrow 160 in FIG. 3. Alternative means may be employed for securing the spring clips to the contact component.

The spring clip components 6 and 8 are mounted in the above described manner within contact 4 and are arranged serially with a pair of serially arranged spring arms 156 generally aligned with and facing angularly away from one or more of the apertures 116 through 124. When the spring clip shown in FIG. 14 is used, wide spring arm 156 is aligned with two apertures 116 and 118. Alternatively, each spring arm may be aligned with a single respective aperture.

The version shown herein depicts two serially arranged spring contacts. However, in alternative versions three or even more spring contacts may be assembled within a contact component in an analogous fashion. As used herein, "serially arranged" means that the depending segments (spring arms) of each set of spring clips are oriented relative to one another and relative to an associated enclosure inlet and associated contact aperture such that, as described below, insertion of a wire into the connector causes the depending spring biased segments of the clips to be sequentially opened. In other words, each of the corresponding depending segments faces angularly away from and is in general alignment with an inlet in the enclosure and an associated aperture in the base portion of the contact.

In the embodiment shown in FIG. 1, a locking connector assembly 2 manufactured in the foregoing manner is permanently installed within enclosure 12, as best shown in FIG. 3. Wall 102 abuts a shoulder 170 and a rib 172 formed within the inner chamber of enclosure. Likewise, the distal lips 98 and 106 abut the inside of enclosure wall 26.

Figure 7:
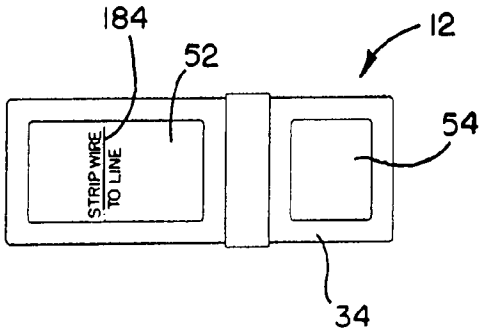
FIG. 7 is a side elevational view of the right hand side of the enclosure, the other side being a mirror image.
Figure 11:
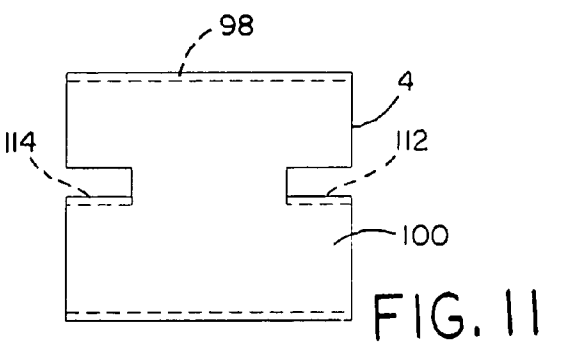
FIG. 11 is a top plan view of the electrical contact component of FIG. 10.

Wires 14 through 22 are secured to connector 10 in the following manner. As shown in FIG. 3, a respective wire (i.e., wire 14) is inserted through its corresponding inlet 60 as well as the aligned aperture 116 in contact component 4. The insulating jacket 180 of the wire is first stripped to a predetermined length and the exposed conductive wire element 182 is inserted through contact aperture 116 and into the aligned channel 136 defined by rib 126. The required length of electrical wire to be stripped of insulation may conveniently be determined by placing a suitably placed line 184 on the exterior of the locking connector assembly or any enclosure in which the locking connector assembly is mounted as schematically shown in FIGS. 2 and 7.

The exposed wire resiliently and sequentially opens the serially aligned spring arms and is pushed through contact component 4 until the distal end of the wire engages and is stopped by lip 106 extending upwardly from plate 104. The spring bias of contacts 6 and 8 urges the spring arms (for example spring arm 156) to bear against and interengage wire element 182 such that the distal end 186 of the outwardly flexed spring arm, shown in solid lines in FIG. 3, grips the wire and establishes electrical interconnection between the contact component 4 and wire element 182. The wire element is held securely between the spring clips and plate section 104. Wire element 182 is effectively gripped at two locations so that it is securely locked within the connector. The angles and spring bias of the spring arms oppose a removal force applied to the wire element and enhance the locking effect of the connector upon the wire element when the wire is pulled against the connector. The mechanical interconnection is such that it is virtually impossible for the wire element to be inadvertently pulled out of the locking connector assembly and disengaged from the contact. Moreover, a reliable electrical interconnection is established.

One or more additional wires (e.g., wires 16–22) may be joined to the connector in a similar fashion so that the respective wires are both mechanically and electrically interconnected in a secure and reliably operable manner. It should be noted that the angularly depending spring arms 156–162 and lower plate section 104 may have curved shapes that complement wire elements 182 so that improved contact is achieved.

Figure 17:
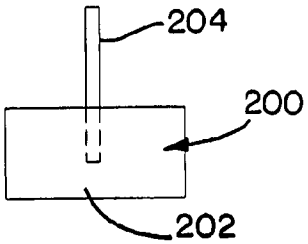
FIG. 17 is an elevational side view of the spring release tool of FIG. 16.
Figure 16:
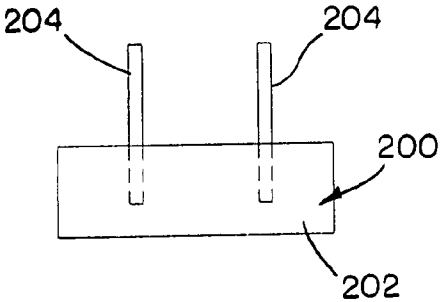
FIG. 16 is a front elevational view of a preferred spring release tool.

In certain cases, the user may wish to disengage the wires from connector 10 and/or install stranded wire using the connector. This may be accomplished without damage to the wire or the connector, by employing a spring release mechanism or tool 200, shown in FIG. 16 and 17. Tool 200 features a block or handle 202 that carries a pair of pins 204. To release the spring lock, the tool is manipulated to insert pins 204 through respective holes 72 in enclosure 12 and corresponding holes 140 in contact component 4. The pins 204 are pushed through the aligned holes to engage spring arms 156. By continuing to push on tool 200, the pins urge spring arms 156 upwardly to disengage exposed wire element 182. This permits the wire to be disengaged from the contact and removed from the enclosure.

Tool 200 is then removed and the spring arms are spring biased into their closed condition represented by 156' (see FIG. 3). In this condition, the spring arms extend across the channel that is accommodated by the wire element when the wire element is inserted into the connector. It should be understood that similar release holes may be employed for releasing any of the serially arranged sets of spring arms 158–162 in connector 10. It should also be noted that the aligned spring release holes 72 and 140 are formed through the connector such that when the release mechanism is inserted, it extends upwardly to engage the spring contact on one side of the inserted wire element. In other words, the wire element does not interfere with insertion of the release mechanism and vice versa. The spring release mechanism is equally effective in opening the spring locking clips to permit the insertion of stranded wire or other conductive components lacking the rigidity or integrity needed to open the spring locking clips by themselves.

Figure 18:
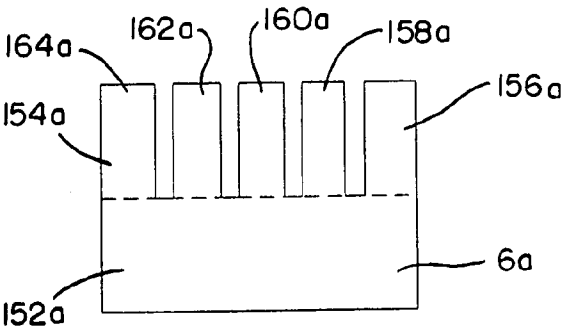
FIG. 18 is a top plan view of an alternative spring locking clip according to this invention in a pre-assembled condition.

An alternative spring contact clip **6*a*, shown in FIG. 18, is designed for use with wires to be permanently connected. In this version, the spring contact clip includes a first segment 152*a* and a second segment 154*a* that includes five spring arms 156*a*, 158*a*, 160*a*, 162*a* and 164*a***. Each of the spring arms is aligned with a respective inlet and corresponding aperture. In this version, the spring contact does not include a portion that is engageable by a release tool. Accordingly, it is designed for use in permanent electrical interconnections. Otherwise, the spring clip is manufactured, inserted and used in a manner analogous to that previously described.

As shown in FIG. 3, electrical connection may also be established between one or more wires, which are joined to the contact component as previously described, and an additional conductor 220. The distal end of conductor 220 is joined by an H-connector 222 to the lips 98 and 106 of assembly 2. As a result conductor 220 is designed to permanently interengage the contact 4. Alternatively, the conductive metal sheet out of which the contact 4 is stamped or otherwise cut may also be stamped or cut to include the conductor 220' as an integral part of the contact as schematically shown in phantom lines in FIG. 9. One or more additional wires (e.g., wire 14) are then joined to the contact 4 in the manner previously described. As a result, those wires are electrically and mechanically interconnected to conductor 220.

Figure 19:
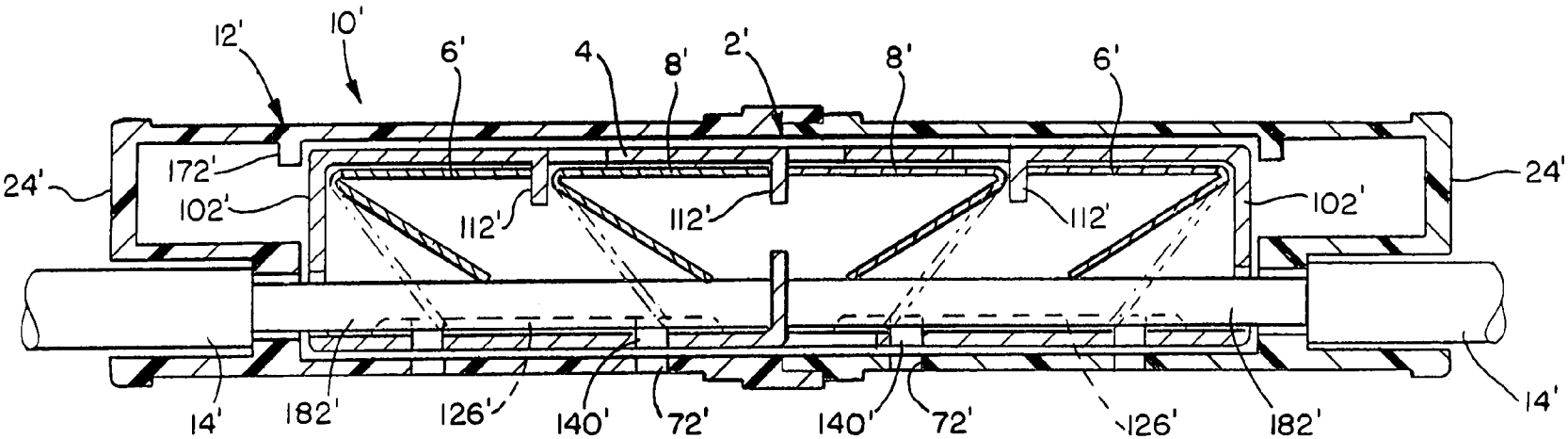
FIG. 19 is an enlarged fragmentary longitudinal section through an alternative electrical connector according to this invention for making end to end wire connections.

In still other embodiments, multiple pairs of opposing spring clips 6' and 8' may be mounted in opposite ends of a contact 4' and arranged to face in opposite directions in alignment with respective apertures in opposite ends of the lock connector 10' as schematically shown in FIG. 19. This construction permits aligned end to end wire connections to be made. Otherwise the details of construction and operation of the connector of FIG. 19 is substantially the same as the connectors previously described, and the same reference symbols followed by a prime symbol are used to designate like parts.

Figure 20:
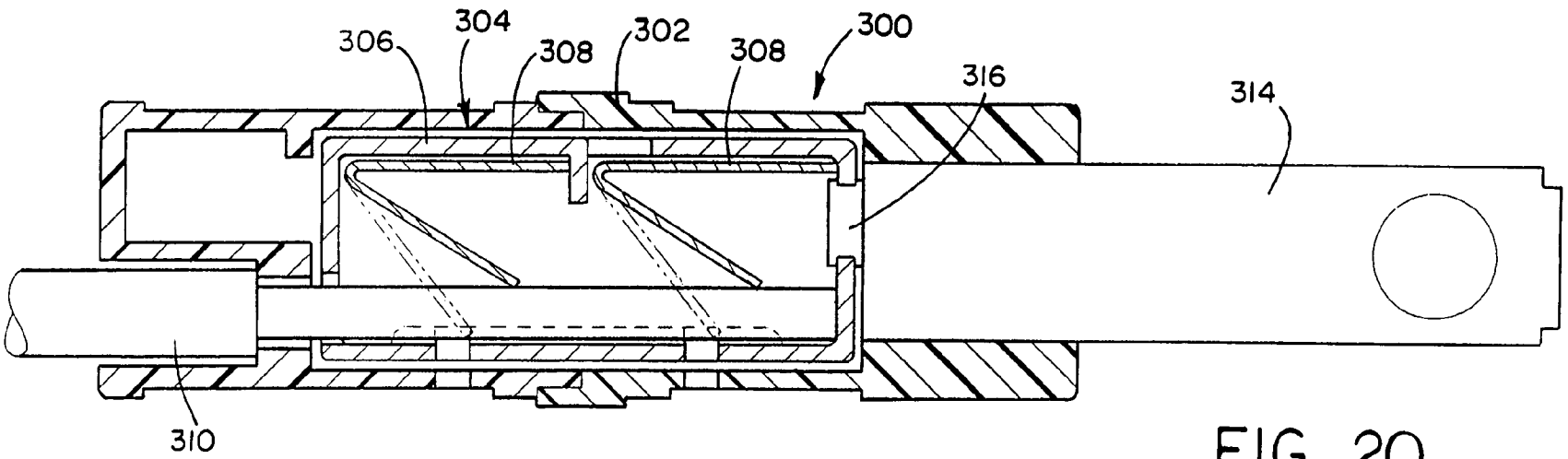
FIG. 20 is an enlarged fragmentary longitudinal section through an electrical plug that incorporates the connector of this invention.

The locking connector of this invention may also be incorporated into various types of electrical appliances and fixtures so that improved connection is achieved. It is not necessarily limited to connecting two or more segments of wire. For example, as shown in FIG. 20, an electrical plug 300 carries a case 302 that extends rearwardly therefrom. A locking connector assembly 304 in accordance with this invention is mounted within case 302. Connector assembly 304 includes a contact component 306 and a pair of serially arranged spring clips 308. The contact component and spring clips are constructed in a manner identical or similar to that previously described. The distal end of an electrical wire 310 is stripped and inserted into an opening in case 302. As previously described, contact component 306 includes an opening that is in alignment with the substantially aligned spring clips 308. When the stripped end of wire 310 is inserted through the contact opening, it resiliently opens clips 308 in a sequential manner. The spring bias of the clips holds them in gripping and electrical interengagement with the wire. The wire electrically interengages contact 306, which is itself connected to the prongs 314 of plug 300 by an appropriate connector such as the previously described H-connector 316. Otherwise, mechanism 304 works in a manner similar to that previously described. A plug manufactured in accordance with FIG. 20 is effective for use in various appliances such as wall lamps. The plug can be permanently connected to the wire, or releasably attached as previously described by using release holes and a corresponding release mechanism.

Assorted other types of electrical appliances may employ the locking connector assembly of this invention. For example, the connector may be employed with industry standard connector heads for low voltage and high voltage connections. Likewise, the connector may be employed in high and low voltage plugs and switches.

In certain embodiments the previously described enclosure is eliminated or modified to fit a particular application. The contact component and spring locking clips may also employ various alternative configurations in accordance with this invention. The connector accomplishes wire to wire, parallel wire and opposing wire connections. A single connector may join multiple wires. Alternatively, multiple wires may be attached to multiple connectors. A single wire likewise may be joined to a single or multiple connector. The locking mechanism enables various types of switches to be interconnected quickly and conveniently between a pair of wires. Likewise, the locking connector is suitable for attaching wiring to both high and low voltage male and female plugs.

The connector of the invention is likewise adaptable for use in light switch boxes and light fixture outlets in residential and commercial applications. Using the locking connector of the present invention is extremely convenient in new construction, remodeling and industrial applications, among others, wherein numerous electrical connections are typically required. The locking design of this mechanism effectively prevents untrained and unskilled persons from disassembling a proper connection and connecting it improperly. Four and five port devices, as described above, are particularly effective for use in new home remodeling and similar industrial and commercial construction use. House wiring is preferably joined to the permanent ports of the connector. The stranded wires from light fixtures are attached to the releasable ports so that light fixtures may be quickly and conveniently installed and removed as required. Various other combinations and configurations of permanent and releasable interconnections may be employed.

The present invention eliminates the problems and aggravations commonly associated with crimping, splicing and soldering wires. An opposed, single port version of the locking mechanism effectively replaces crimp style wire connectors. Opposed configurations are particularly useful where alignment of the wires is an important consideration. The locking mechanism may be incorporated into various other devices such as a ring connector for a battery terminal. The device may also be utilized to securely fasten aluminum service cable to the main electrical service panel of the building. The spring clips flex with the normal expansion and contraction of the aluminum cable and therefore maintain a tight and effective connection.

The locking mechanism of this invention, in different sizes, may be used effectively with virtually all gauges and types of wires and other electrical connectors. This includes, but is not limited to, house wiring, commercial and industrial building wiring, marine wiring and electronic wiring of the type used in computers and audio equipment. The connector is also effective for use with shielded and coaxial cable.

In embodiments featuring an enclosure, the enclosure may be filled with an epoxy, gel or potting compound after the electrical connection is made. Likewise, in embodiments that do not include an enclosure, the connector itself may be filled with an epoxy, gel or potting compound after the connection is made. This protects the connector from moisture and corrosion.

The tin plated copper construction and the improved, longer and tighter interengagement between the conductor and the contact achieves significantly improved electrical conductivity and performance.

Accordingly, the connector of this invention enables any plurality of electrically conductive components to be mechanically and electrically joined in a quick, convenient and secure manner. Even untrained persons, with little or no electrical knowledge, can perform electrical connections quickly, conveniently and in a virtually failsafe manner. Gripping and electrical interengagement are established at multiple locations along the length of the conductor. As a result, a much improved, secure and highly effective and conductive connection is achieved. Reliable electrical contact is established and unintentional disengagement is avoided. The contact component is substantially longer (front to back) than existing components of this type and the use of a permanently sealed, one piece enclosure prevents the enclosures from being pulled apart under stress or tension.

In certain embodiments, the connector can be used in any application that joins two or more wires together and/or joins one or more wires to any other type of electrical connector.

While specific features of the invention are shown in some drawings and not in others, this is for convenience only, as each of the features may be combined with any or all of the other features in accordance with the invention.

Although the invention has been shown and described with respect to certain preferred embodiments, it is obvious that equivalent alterations and modifications will occur to others skilled in the art upon the reading and understanding of the specification. The present invention includes all such equivalent alterations and modifications and is limited only by the scope of the claims.

What is claimed is:

1. A locking connector for electrically interconnecting two or more electrical conductors:

an electrical contact component electrically interengaged with a first conductor, said contact component including a contact section and an opening that receives a second conductor; and at least one spring locking clip that is spring biased to grip the second conductor and hold the second conductor in electrical interengagement with said contact section, while resisting disengagement of the second conductor from said contact section, said clip having a grip locking end portion that is transversely curved across the entire width of said grip locking end portion to conform to the profile of the second conductor.

2. A locking connector for electrically interconnecting two or more electrical conductors comprising:

an electrical contact component electrically interengaged with a first conductor, said contact component being made of metal sheet material having a contact section, another section in parallel spaced relation from said contact section, an intermediate section that interconnects one end of each of said contact section and said another section, an opening extending through said intermediate section that receives a second conductor, and an inturned lip integral with said contact section in axial spaced relation from said opening in said intermediate section that acts as a stop for said second conductor when inserted through said opening in said intermediate section;

at least one spring locking clip that is spring biased to grip the second conductor and hold the second conductor in electrical interengagement with said contact section, while resisting disengagement of the second conductor from said contact section; and a release hole formed through said contact section transversely offset from said opening for receiving a clip release element, said clip having a portion extending transversely outward of said opening in line with said release hole for engagement by the clip release element upon insertion of the clip release element into the release hole to urge said clip into an open condition to permit unobstructed insertion and removal of the second conductor into and out of said contact component.

3. The connector of claim 2 wherein said clip has a first segment that fits tightly between said intermediate section and another inturned lip integral with said another section in spaced relation from said intermediate section to secure said clip to said contact component, and a second segment depending from said first segment at an angle, said second segment being spring biased toward said contact section.

4. The connector of claim 2 wherein said contact component has opposite ends, said opening that receives the second conductor extending through one of said ends, and another opening that receives the first conductor extending through the other of said ends, and at least one additional spring locking clip that is spring biased to grip the first conductor and hold the first conductor in electrical interengagement with said contact section, while resisting disengagement of the first conductor from said contact section.

5. The connector of claim 4 further comprising another release hole formed through said contact section transversely offset from said another opening for receiving a clip release element, said additional clip having a portion extending transversely outward of said another opening in line with said another release hole that is engageable by the clip release element upon insertion of the clip release element into said another release hole to urge said additional clip into an open condition to permit unobstructed insertion and removal of the first conductor into and out of said contact component.

6. A locking connector for electrically interconnecting two or more electrical conductors comprising:

an electrical contact component electrically interengaged with a first conductor, said contact component including a contact section and an opening that received a second conductor;

at least one spring locking clip that is spring biased to grip the second conductor and hold the second conductor in electrical interengagement with said contact section, while resisting disengagement of the second conductor from said contact section, said clip having a grip locking end portion in alignment with said opening that is spring biased to grip the second conductor, said grip locking end portion being transversely curved across the full width of said grip locking end portion to conform to the profile of the second conductor; and a release hole formed through said contact section transversely offset from said opening for receiving a clip release element, said clip having a portion extending transversely outward of said opening in line with said release hole for engagement by the clip release element upon insertion of the clip release element into the release hole to urge said clip into an open condition to permit unobstructed insertion and removal of the second conductor into and out of said contact component.

7. A locking connector for electrically interconnecting two or more electrical conductors comprising:

an electrical contact component electrically interengaged with a first conductor, said contact component being made of metal sheet material having a contact section, another section in parallel spaced relation from said contact section, an intermediate section that interconnects one end of each of said contact section and said another section, an opening extending through said intermediate section that receives a second conductor, and an inturned lip integral with said contact section in axial spaced relation from said opening in said intermediate section that acts as a stop for said second conductor when inserted through said opening in said intermediate section; and at least one spring locking clip that is spring biased to grip the second conductor and hold the second conductor in electrical interengagement with said contact section, while resisting disengagement of the second conductor from said contact section.

8. The connector of claim 7 further comprising an enclosure that includes a generally rectilinear component having an interior space that accommodates said contact component, said rectilinear component including a front surface having an inlet aligned with said opening for receiving the second conductor, and a rib that peripherally surrounds said rectilinear component and extends transversely to said front surface, said generally rectilinear component including at least one surface that has a recess formed therein which facilitates a user's grip.

9. The connector of claim 7 wherein said clip has a first segment that fits tightly between said intermediate section and another inturned lip integral with said another section in spaced relation from said intermediate section to secure said clip to said contact component, and a second segment depending from said first segment at an angle, said second segment being spring biased toward said contact section.

10. The connector of claim 7 wherein said first conductor is integral with said contact component.

11. The connector of claim 7 wherein said first conductor has a wire terminal connection with said contact component.

12. The connector of claim 7 wherein said contact section includes an elongate rib formed in said contact section transversely offset from said opening for locating the second conductor relative to said clip; and a release hole extending through said elongate rib transversely offset from said opening for receiving a clip release element, said clip having a portion extending transversely outwardly of said opening in line with said release hole for engagement by the clip release element upon insertion of the clip release element into the release hole to urge said clip into an open condition to permit unobstructed insertion and removal of the second conductor into and out of said contact component.

13. The connector of claim 7 further including an enclosure that accommodates said contact component, said enclosure having an inlet aligned with said opening for receiving the second conductor.

14. The connector of claim 13 wherein said enclosure includes a unitary component.

* * * * *